US005764490A

United States Patent [19]

Barbier et al.

[11] Patent Number: 5,764,490

[45] Date of Patent: Jun. 9, 1998

[54] INTERFACE DEVICE INCLUDING A BASE AND MECHANICAL FASTENING OF ADDITIONAL TERMINAL BLOCKS TO THE BASE

[75] Inventors: René Barbier, Remilly Sur Tille; Marc Soulas, Dijon; Hervé Muller, Savolles, all of France

[73] Assignee: Schneider Electric SA, Boulogne Billancourt, France

[21] Appl. No.: 595,497

[22] Filed: Feb. 1, 1996

[30] Foreign Application Priority Data

Feb. 10, 1995 [FR] France ..... 95 01646

[51] Int. Cl.[6] ..... H01R 9/24; H01R 9/26

[52] U.S. Cl. ..... 361/823; 361/740; 361/741; 361/743; 361/756; 361/788; 439/716

[58] Field of Search ..... 361/731, 732, 361/733, 740, 741, 743, 756, 759, 788, 796, 801, 802, 807, 809, 810, 823; 439/532, 540.1, 709, 715, 716, 717, 928

[56] References Cited

U.S. PATENT DOCUMENTS

| | | | |
|---|---|---|---|
| 4,239,324 | 12/1980 | Stenz | 439/717 |
| 4,672,511 | 6/1987 | Meusel et al. | 361/802 |
| 4,929,186 | 5/1990 | Steinkuhle et al. | 439/717 |
| 5,472,347 | 12/1995 | Nordenstrom et al. | 439/928 |
| 5,655,922 | 8/1997 | Dux et al. | 439/717 |

FOREIGN PATENT DOCUMENTS

| | | |
|---|---|---|
| A-0 399 091 | 11/1990 | European Pat. Off. . |
| B-28 33 313 | 9/1979 | Germany . |

OTHER PUBLICATIONS

Patent Abstracts of Japan, vol. 17, No. 289, Jun. 3, 1993 & JP-A-05 021099, Jan. 29, 1993, abridged.

*Primary Examiner*—Leo P. Picard
*Assistant Examiner*—John B. Vigushin
*Attorney, Agent, or Firm*—Oblon, Spivak, McClelland, Maier & Neustadt, P.C.

[57] ABSTRACT

An interface device that includes a base having a body between top and bottom longitudinal flanges, a circuit board, and an interface unit including a first terminal block with a row of aligned terminals at a front of the block where the aligned terminals are electrically connected to a circuit board mounted on the base. The interface device includes an additional terminal block attached to a bottom of the base by a retainer. The retainer is constructed in the form of M-shaped members attached to a face of the additional terminal block, that clip into a longitudinal groove on the bottom of the base. The additional terminal block may be mounted such that terminals on the additional terminal block are parallel to terminals on the first terminal block and set back therefrom. The body of the base also includes a longitudinal slideway in which longitudinal edges of the printed circuit board are accommodated.

10 Claims, 2 Drawing Sheets

INTERFACE DEVICE INCLUDING A BASE AND MECHANICAL FASTENING OF ADDITIONAL TERMINAL BLOCKS TO THE BASE

BACKGROUND OF THE INVENTION

1. Field of the Invention

The present invention concerns an interface device comprising a base constituted by a profiled member having a central body between top and bottom longitudinal flanges, a printed circuit board mounted on the base, and at least one interface unit including a terminal block provided at the front with a row of aligned terminals, fixed and electrically connected at the rear to the printed circuit by connecting pins soldered to the latter.

2. Discussion of the Background

An interface device is intended to be disposed electrically between a processor unit such as a programmable automatic controller and an electrical equipment to be operated or controlled by the processor unit. The interface function is implemented by interface units that routinely include a first terminal block for connecting cables transmitting input signals from transmitters to the automatic controller or transmitting output signals from the automatic controller to actuators. The interface units may include a second terminal block disposed below the first terminal block and used in exactly the same way as the first terminal block or to distribute one power supply polarity. Each terminal block is provided with a row of aligned connecting terminals mounted on connecting pins soldered to the printed circuit of the device, this row of the second terminal block being parallel to and offset in the depthwise direction relative to that of the first terminal block.

It is sometimes beneficial to provide in a device of this kind a third terminal block that can be used for an earth connection, for example, or to distribute the other power supply polarity; this terminal block has a row of terminals parallel to the other two rows and provided with connecting pins soldered to the same printed circuit of the device. In the current state of the art an interface device is therefore manufactured with one, two or three rows of terminals; it is therefore impossible for a user who possesses a device with two terminal blocks to add a further terminal block to provide a third row of terminals.

SUMMARY OF THE INVENTION

Consequently, the invention is directed to proposing an interface device to which an additional terminal block can easily be added.

In accordance with the invention, the device is characterized in that the additional terminal block is dissociated from the interface unit and from the printed circuit board and can be mounted below the base by retaining means that clip into at least one longitudinal groove provided in the bottom flange of the profiled member, preferably in the bottom face of this flange.

The retaining means can advantageously consist in clipping members, for example M-shape members, attached to the top face of the body of the additional terminal block. These members comprise a core, lateral feet joined to the core and bearing on said top face and an elastic tongue attached to the core adapted to clip irremovably into the groove in the profile member.

The retaining means preferably alternate along two parallel longitudinal axes of the additional terminal block and cooperate with two parallel longitudinal grooves in the bottom face of the bottom flange of the profiled member. This arrangement improves the mechanical retention of the terminal block to the base.

The top face of the body of the additional terminal block has shaped parts that cooperate with a complementary profiled groove in the bottom face of the base to attach the terminal block to the base.

BRIEF DESCRIPTION OF THE DRAWINGS

The invention will now be described in more detail, by way of example and with reference to the appended drawings, in which.

DESCRIPTION OF THE PREFERRED EMBODIMENTS

Figure 1:
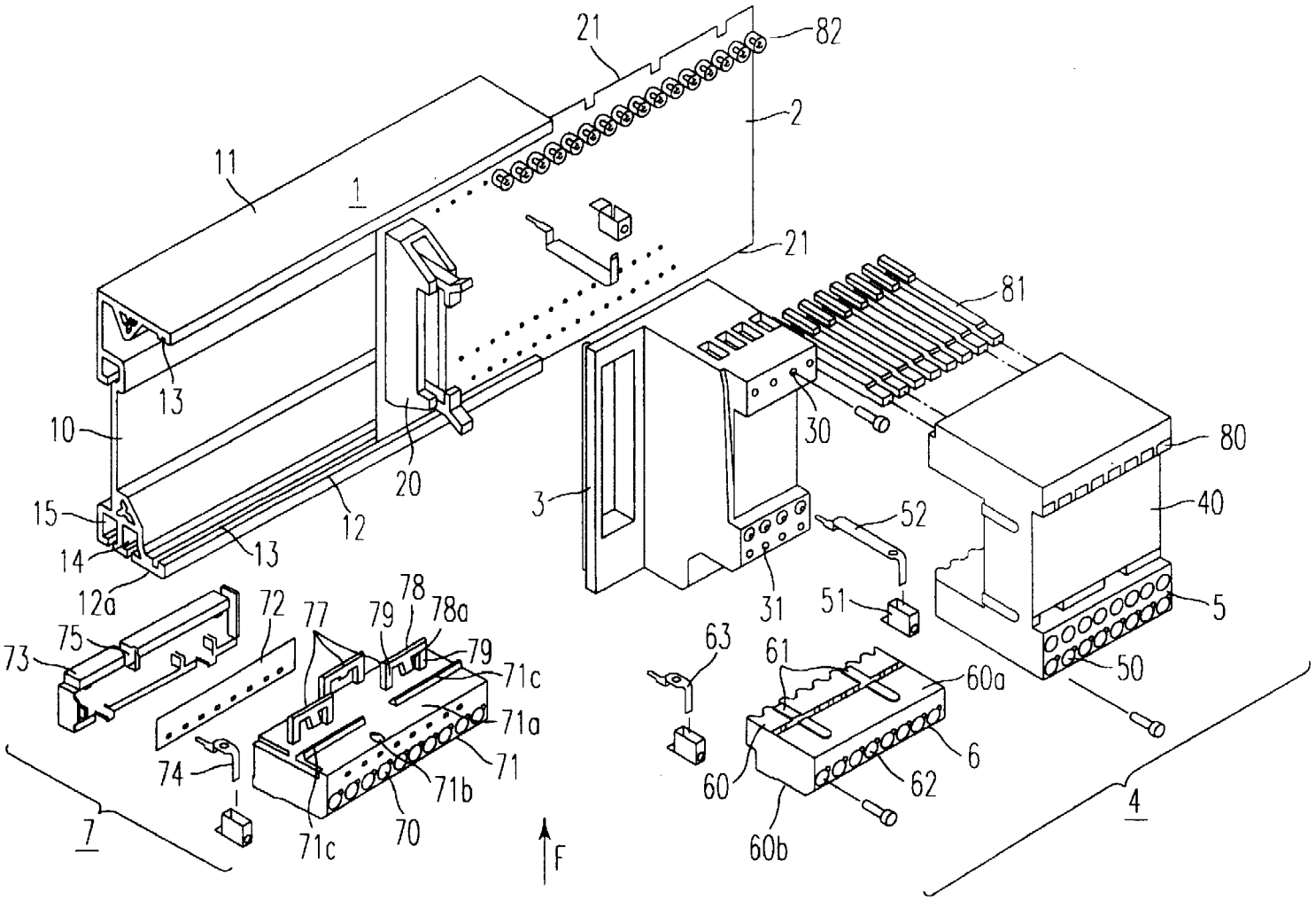
FIG. 1 shows an exploded view of the interface device of the invention.
Figure 2:
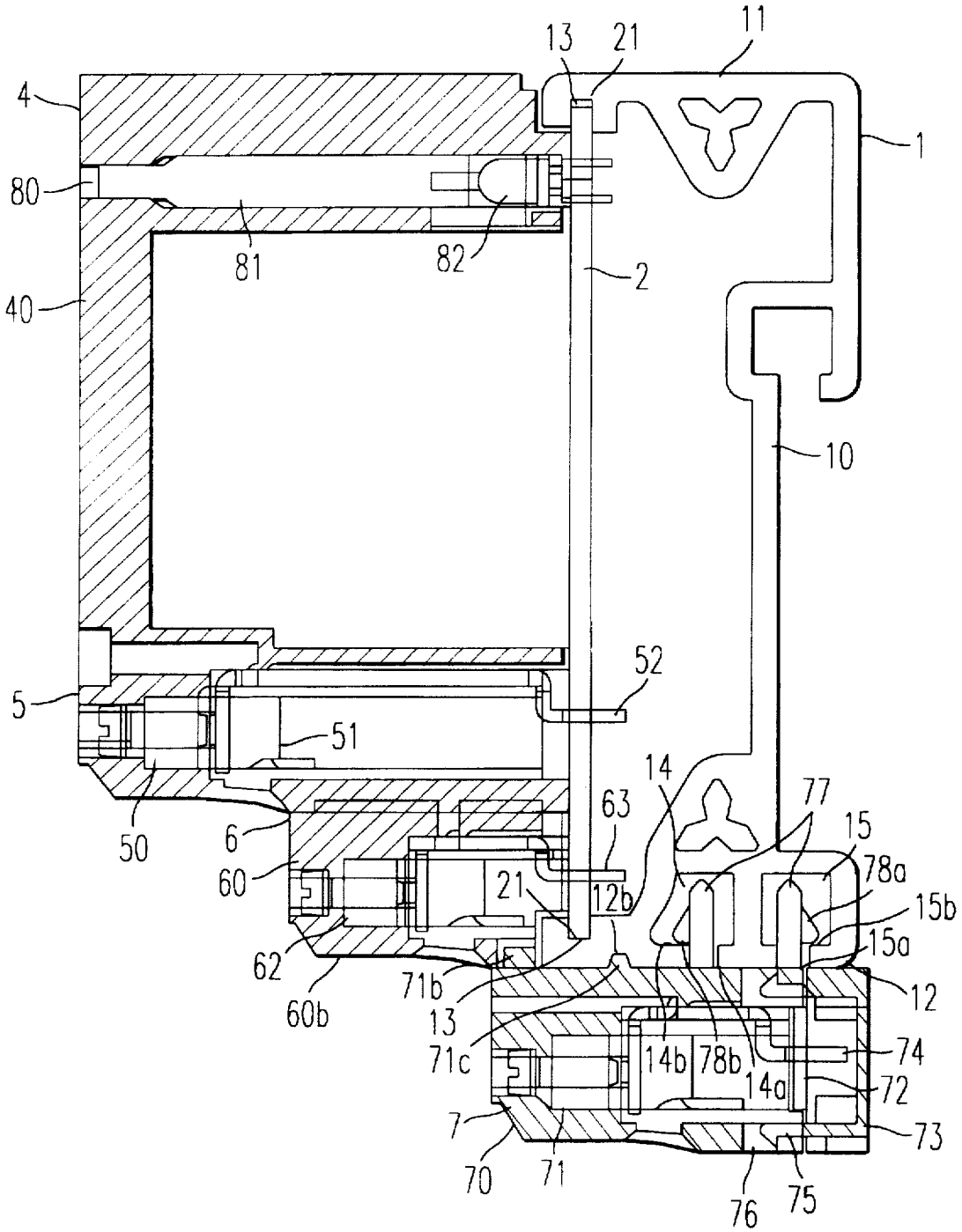
FIG. 2 shows a sectional view of the device.

The interface device seen in FIG. 1 is intended to be disposed electrically between a processor unit, for example a programmable automatic controller, and an electrical equipment to be operated or controlled by that unit.

The device comprises a base 1, a printed circuit board 2, a power supply unit 3 and at least one interface unit 4. At the front of the interface unit 4, in its lower part, there are an integral top terminal block 5 and an attached bottom terminal block 6 parallel to and offset in the depthwise direction relative to the terminal block 5. The device further comprises an additional terminal block 7 adapted to be mounted under the base 1 and to be disposed parallel to and offset in the depthwise direction relative to the other two terminal blocks.

The base 1 is an extruded profiled member adapted to be mounted by conventional fixing means on a rail attached to a wall or panel. The extrusion comprises, in one piece, a central body 10 and top and bottom longitudinal flanges 11, 12 extending forwardly of respective edges of said body.

The flanges 11 and 12 have respective longitudinal slideways 13 on their inside face and the bottom flange 12 has two parallel longitudinal grooves 14 and 15 on the bottom, in its external or bottom face 12*a*.

The thin board 2 is mounted on the base 1 so that its longitudinal edges 21 are accommodated in the slideways 13. It comprises a printed circuit and a multiway connector 20 soldered to this circuit; the connector is designed to be connected to the automatic controller and the printed circuit connects each pin of the connector to one channel of the interface unit 4 or the power supply unit 3.

The power supply unit 3 has power supply terminals 30 for distributing the power supply voltage to the processor unit and power supply terminals 31 for distributing the control voltage to the electrical equipment.

The interface unit 4 comprises a module 40 with the integral top terminal block 5 in its lower part.

The terminal block 5 has a row of aligned terminals 50. Each terminal 50 is a screw terminal with a captive cage 51 and a connecting pin 52 soldered to the printed circuit to enable electrical connection thereto of a cable inserted into the terminal. The connecting pin 52 also fixes the module 40 mechanically to the board 2.

The upper part of the module 40 can accommodate light diffusers 81 in line with light-emitting diodes 82 soldered to the printed circuit to conduct light from these diodes to windows 80 at the front of the module.

The attached bottom terminal block 6 of the interface unit is mounted under the terminal block 5. It comprises a body 60 which has on its top face 60*a* transverse ribs 61 which cooperate with ribs on the bottom face of the module 40. The bottom face 60*b* of the body 60 is at the same level of the horizontal outside face 12*a* of the bottom flange 12 of the base.

The terminal block 6 comprises a row of aligned screw terminals 62 of the captive cage type with connecting pins 63 soldered to the printed circuit. This second row of terminals 62 is parallel to the row of terminals 50 and offset relative to it in the depthwise direction.

The additional terminal block 7 comprises a row of aligned terminals 70 connected together and, for example, used for an earth connection or to distribute the power supply polarity opposite to the polarity distributed by the terminal block 6.

The terminal block comprises a body 71, an additional printed circuit board 72 and a base 73. The captive cage type screw terminals 70 have connecting pins 74 that are soldered to the printed circuit of the additional board 72 to make an electrical connection between these pins and to contribute to mechanical fixing of the additional board 72 to the body 71. The base 73 is designed to be mounted to the rear of the body 71 in order to protect the printed circuit board and to close the body of the terminal block; this closure of the rear of the terminal block is achieved by means of clipping means 75 provided on the base 73 that engage in openings 76 on the body 71.

The additional terminal block constitutes a monobloc assembly and is mounted under the base 1 of the device, below the bottom terminal block 6, so that the row of terminals 70 is parallel to and offset in the depthwise direction relative to the other two rows of terminals 50 and 60. A locating lug 71*b* is preferably provided on the surface 71*a* of the additional terminal block to cooperate with an opening in the interface unit or in the surface 60*b* of the terminal block 6 in order to register the terminals 70 vertically with and parallel to the terminals 50.

The terminal block 7 is fixed to the base by retaining means 77. These retaining means are attached to the top face 71*a* of the body 71 of the terminal block and alternate on two parallel longitudinal axes of the body 71. They are adapted to cooperate with the grooves 14 and 15 in the extrusion. The horizontal top face 71*a* of the body 71 of the terminal block is therefore pressed against the horizontal bottom face 12*a* of the base.

The retaining means 77 are of the clip or like type. They comprise M-shape members each of which includes a core 78 and two lateral feet 79 at respective ends of the core and bearing firmly on the top face 71*a*. In the middle of the core there is an elastic tongue 78*a* with oblique sides which can be clipped irremovably into the groove 14 or 15.

To mount the additional terminal block under the base 1, it is located under the interface unit 4 by means of the locating lug 71*b* and the core 78 of the retaining means is engaged in the grooves 14 and 15 on the extrusion. An upward, substantially vertical force F is then applied to the terminal block to compress the elastic tongues 78*a* at the level of the openings 14*a* and 15*a* of the grooves, which they therefore enter, then expanding so that the edges 78*b* of the tongues are retained by the internal rims 14*b* and 15*b* of the grooves. The members 77 alternate on the two axes with the tongues oriented in opposite directions. As a result, the edges 78*b* of the tongues bear alternately on the rims 14*b* and 15*b* of the grooves, for improved mechanical retention of the terminal block. To further strengthen this retention, it is possible to attach (for example to glue) shaped pieces 71*c* on the surface 71*a* of the terminal block into a complementary profiled groove 12*b* on the face 12*a* of the base.

The electrical connection of the additional terminal block is effected by means of an external electrical wire connected by the user between a terminal 70 and, for example, a terminal 31 of the power supply unit 3, to distribute one polarity of the power supply.

What is claimed as new and desired to be secured by Letters Patent of the United States is:

1. An interface device, comprising:

a base constituted by a profiled member having a central body between top and bottom longitudinal flanges;

a printed circuit board mounted on the base;

at least one interface unit including, a first terminal block having a first row of aligned terminals at a front of the first terminal block, and connecting pins fixed at a rear of the first terminal block and soldered to the printed circuit board, said connecting pins electrically connected to said first row of aligned terminals; and an additional terminal block dissociated from the interface unit and from the printed circuit board including, a retaining means that adapts said additional terminal block to be mounted under the base by cooperating with the base.

2. The interface device according to claim 1, further comprising at least one longitudinal groove in a bottom face of the bottom longitudinal flange of the profiled member;

wherein the retaining means clip into said at least one longitudinal groove.

3. The interface device according to claim 2, wherein:

the retaining means comprise M-shape members attached to a top face of a body of the additional terminal block; and said M-shape members each comprise, a core, lateral feet joined to the core and bearing on the top face of the body of the additional terminal block, and an elastic tongue attached to the core and adapted to be clipped irremovably to the longitudinal groove.

4. The interface device according to claim 1, further comprising two parallel longitudinal grooves on a bottom face of the bottom longitudinal flange of the profiled member;

wherein said retaining means alternate between two parallel longitudinal axes of the additional terminal block and cooperate with said two parallel longitudinal grooves.

5. The interface device according to claim 1, wherein the additional terminal block comprises:

a body including, an additional row of aligned terminals on a front of said body, terminal block connecting pins electrically connected to said additional row of aligned terminals, and an additional printed circuit board to which the terminal block connecting pins are soldered; and a base closing and protecting the additional printed circuit board in the body of the additional terminal block so as to form a monobloc assembly.

6. The interface device according to claim 5, wherein:

the body of the additional terminal block having a top face pressed against a bottom face of the base; and the additional row of aligned terminals of the additional terminal block being parallel to and offset in a depthwise direction relative to the first row of aligned terminals of the first terminal block of the interface unit.

7. The interface device according to claim 5, wherein the additional terminal block further comprises a lug on a top face of the additional terminal block for locating the additional terminal block under the interface unit so the additional row of aligned terminals of the additional terminal block are disposed vertically in line with the first row of aligned terminals of the first terminal block.

8. The interface device according to claim 1, wherein the additional terminal block further comprises shaped pieces on a top face of the additional terminal block that cooperate with a complementary profile groove in a bottom face of the base to attach the additional terminal block to the base.

9. The interface device according to claim 1, wherein the interface unit comprises a second terminal block under the first terminal block so that a bottom face of the second terminal block is at a same level as a bottom face of the base.

10. The interface device according to any one of the preceding claims wherein the top and bottom longitudinal flanges of said profiled member respectively have internal faces each having a longitudinal slideway in which longitudinal edges of the printed circuit board are accommodated.

* * * * *